US006800152B2

(12) United States Patent
Gundlach et al.

(10) Patent No.: US 6,800,152 B2
(45) Date of Patent: Oct. 5, 2004

(54) PROCESS FOR MAKING IRON-BASED CASTING ALLOY

(75) Inventors: Richard B. Gundlach, Farmington, MI (US); Sumita Majumdar, Canton, MI (US)

(73) Assignee: Climax Research Services, Inc., Farmington Hills, MI (US)

( * ) Notice: Subject to any disclaimer, the term of this patent is extended or adjusted under 35 U.S.C. 154(b) by 0 days.

(21) Appl. No.: 10/635,178

(22) Filed: Aug. 6, 2003

(65) Prior Publication Data

US 2004/0025988 A1 Feb. 12, 2004

Related U.S. Application Data

(62) Division of application No. 08/857,991, filed on May 16, 1997, now Pat. No. 6,669,790.

(51) Int. Cl.[7] ..... C21D 6/02; C21D 8/00

(52) U.S. Cl. ..... 148/622; 148/612; 148/614; 148/616; 148/659

(58) Field of Search ..... 148/612, 614, 148/616, 622, 659; 420/70, 104, 426, 427

(56) References Cited

U.S. PATENT DOCUMENTS

| | | | | |
|---|---|---|---|---|
| 3,929,471 | A | 12/1975 | Akahori et al. | |
| 4,221,612 | A | 9/1980 | Thome | |
| 4,325,758 | A | 4/1982 | Milligan | |
| 4,490,175 | A | 12/1984 | Matsuzaki | |
| 5,096,515 | A | 3/1992 | Kawamura et al. | |
| 5,252,149 | A | 10/1993 | Dolman | |
| 5,310,431 | A | 5/1994 | Buck | |
| 5,316,596 | A | 5/1994 | Kataoka | |
| 5,733,388 | A | 3/1998 | Kurebayashi et al. | |
| 6,375,764 | B1 * | 4/2002 | Ito et al. | 148/326 |

FOREIGN PATENT DOCUMENTS

| | | |
|---|---|---|
| EP | 0 430 241 A1 | 6/1991 |
| EP | 0 533 929 A1 | 12/1991 |
| JP | 64-42553 | 2/1989 |
| JP | 11-61322 | 3/1999 |
| JP | 11-229070 | 8/1999 |

OTHER PUBLICATIONS

Solidification Structures of Fe–C–CR–(V–NB–W) Alloys, Transactions of American Foundrymen's Society. 1986. pp. 403–416.

* cited by examiner

*Primary Examiner*—John P. Sheehan
(74) *Attorney, Agent, or Firm*—Brooks Kushman P.C.

(57) ABSTRACT

A process for making an iron-based casting alloy is performed by combining an iron-carbon-chromium system with primary carbides of vanadium, niobium, titanium, or combinations thereof without eutectic carbides of vanadium, niobium and titanium. Eutectic chromium carbides ($M_7C_3$) are also formed without primary chromium carbides. Proeutectic austenite can also be formed in the alloy.

4 Claims, 3 Drawing Sheets

PROCESS FOR MAKING IRON-BASED CASTING ALLOY

This application is a divisional of prior application Ser. No. 08/857,991 filed on May 16, 1997 and now U.S. Pat. No. 6,669,790.

TECHNICAL FIELD

This invention relates to an improved iron-based casting alloy having improved combinations of toughness, abrasion resistance and corrosion resistance, and the invention also relates to a process for making the alloy.

BACKGROUND ART

There are many applications for which it is desirable to have iron-based alloys that are castable and have improved combinations of toughness, abrasion resistance and corrosion resistance. For example, the paper making industry casts refiner plate alloys which can advantageously increase production at faster speeds. However, at these faster speeds, the cast refiner plates wear faster and are more susceptible to brittle fracture.

Cast alloys of iron, chromium, vanadium, niobium, and tungsten have previously been studied by A. Sawamoto et al. as set forth in the Transactions of American Foundrymen's Society, 1986, pages 403–416. While this experimental work studied these alloy systems, the investigations did not optimize the microstructure to provide tougher, more wear and corrosion resistant alloys.

DISCLOSURE OF THE INVENTION

One object of the present invention is to provide an improved process for making an iron-based casting alloy having improved combinations of toughness, abrasion resistance and corrosion resistance.

In carrying out the above object, the process of the invention for making the iron-based casting alloy is performed by precipitating eutectic chromium carbides of a first alloy system and primary carbides of a second alloy system including either vanadium carbides, niobium carbides, titanium carbides or combinations of these carbides. The primary carbides are precipitated at a primary carbide liquidus of the second alloy system which has a eutectic that is maintained below an austenite liquidus of the first alloy system to prevent formation of eutectic carbides of the second alloy system.

The eutectic chromium carbides of the first alloy system are precipitated at a eutectic thereof without forming primary chromium carbides.

Proeutectic austenite can be precipitated at an austenite liquidus of the first alloy system prior to the precipitation of the eutectic chromium carbides.

The objects, features, and advantages of the present invention are readily apparent from the following detailed description of the best modes for carrying out the invention when considered with the accompanying drawings.

MODES FOR CARRYING OUT THE INVENTION

Figure 1:
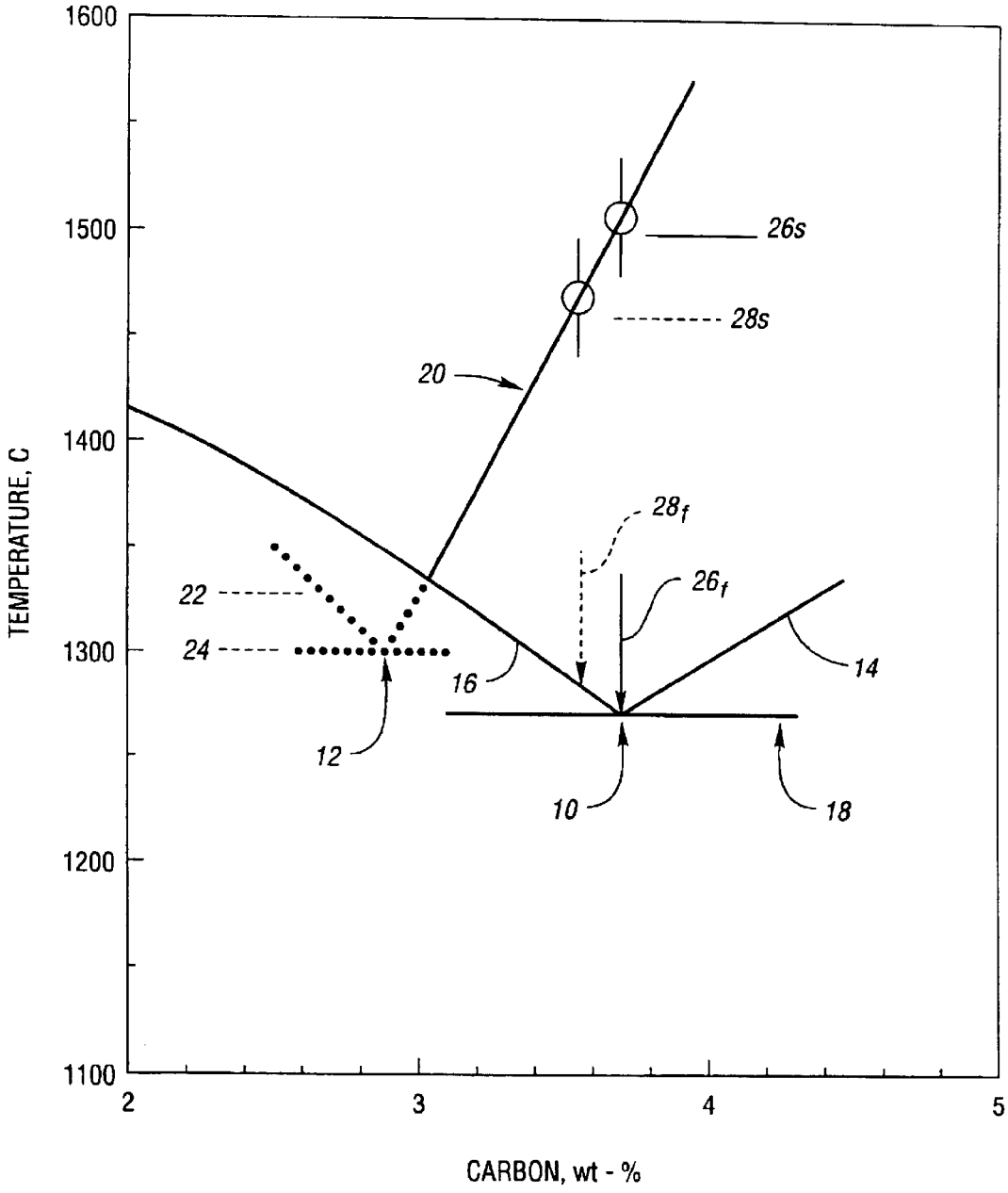
FIG. 1 is a graphical representation of the iron-carbon-chromium phase diagram shown by solid line representation and the iron-carbon-M phase diagram by dotted line representation with M metal being niobium, vanadium, or titanium.

With reference to FIG. 1, this schematic phase diagram shows the eutectic 10 of the iron-carbon-chromium alloy systems and also shows the eutectic 12 of the iron-carbon-M alloy systems. The alloying component M utilized in accordance with this invention is vanadium, niobium, titanium, or combinations of these elements.

The iron-chromium system has a primary carbide liquidus 14 between the two phase region of liquid and liquid and primary chromium carbide. In addition, this iron-carbon-chromium system has an austenite liquidus 16 between the liquid phase and the two phase region of liquid and proeutectic austenite. Furthermore, the iron-carbon-chromium system has a phase transformation 18 at its eutectic 10, below which any remaining liquid entirely solidifies by eutectic transformation as eutectic chromium carbide and eutectic austenite.

With continuing reference to FIG. 1, the iron-carbon-M system has a primary carbide liquidus 20 between the liquid phase and the two phase region of liquid and primary carbides of vanadium, niobium, titanium, and combinations of these carbides. In addition, this system has an austenite liquidus 22 between the liquid phase and the two phase region of liquid and proeutectic austenite. Furthermore, below an isothermal phase transformation 24 at the eutectic 12, the remaining liquid solidifies by eutectic transformation as eutectic carbide and eutectic austenite.

It will be noted in FIG. 1 that, in accordance with the present invention, the eutectic 12 of the iron-carbon-M system is located below the hypoeutectic austenite liquidus 16 of the iron-carbon-chromium system such that there is no formation of eutectic carbides of vanadium, niobium, or titanium. Any such eutectic carbides of vanadium, niobium, or titanium would decrease the bulk hardness of the alloy because substantially more eutectic austenite and less eutectic carbides form in the iron-carbon-M system than in the iron-carbon-chromium system.

With continuing reference to FIG. 1, in one practice of the invention, the initial transformation from the liquid phase begins at 26*s* and first passes through the primary carbide liquidus 20 of the iron-carbon-M system to form primary carbides that may be vanadium carbides, niobium carbides, titanium carbides, or combinations of these carbides, but never reaches the eutectic 12 such that there are substantially no eutectic carbides of this system. In addition, the transformation continues until reaching the eutectic 10 of the iron-carbon-chromium system as identified by 26*f* at which point eutectic chromium carbides ($M_7C_3$) form with eutectic austenite but with substantially no proeutectic chromium carbides. Any such proeutectic chromium carbides would form large rod-like particles that significantly reduce toughness and thus embrittle the alloy.

In another practice of the invention, but with a relatively lesser amount of carbon, the same transformation takes place as described above starting at 28*s* at the hypereutectic primary carbide liquidus 20 of the iron-carbon-M system. However, because of the lesser amount of carbon, the proeutectic austenite liquidus 16 is reached before reaching the eutectic 12 and consequently the alloy forms proeutectic austenite before finally forming the eutectic chromium carbides ($M_7C_3$) and eutectic austenite.

The eutectic austenite and any proeutectic austenite may not be stable upon cooling to ambient and may transform to martensite, pearlite or combinations of martensite and pearlite. Heat treatment can be performed to form martensite that hardens the alloy so as to be more wear resistant. It is also possible to temper the alloy to convert the martensite to ferrite and carbide so as to be more machinable. In addition, it is also possible to heat treat the alloy to form soft pearlite for improving machinability and after machining the alloy can again be heat treated to produce martensite for greater abrasion resistance.

Figure 2:
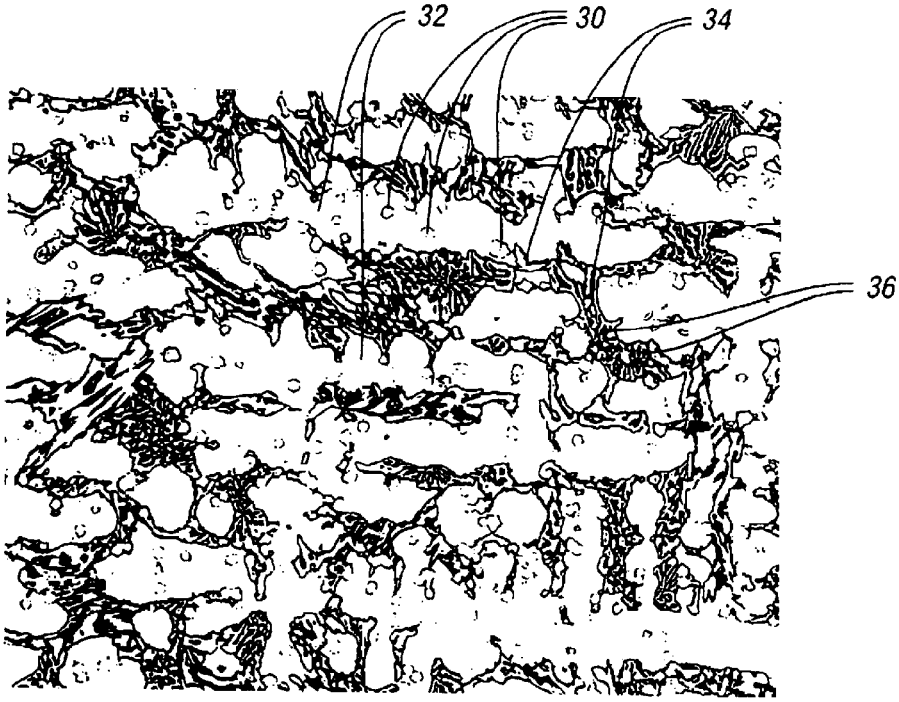
FIG. 2 shows a microstructure of one alloy according to the invention and made by the process of the invention.

FIG. 2 illustrates at 200 magnification one example of a microstructure of an alloy according to the present invention. This alloy by weight is composed of:

2.8% Carbon

16% Chromium

6% Niobium 0.5% Molybdenum 0.6% Nickel

Balance Iron

This alloy includes primary MC niobium carbides, proeutectic austenite dendrites, eutectic $M_7C_3$ chromium carbides and eutectic austenite. The primary MC niobium carbides 30 are small compact particles dispersed in the proeutectic austenite dendrites 32. Eutectic $M_7C_3$ chromium carbides 34 (white) and eutectic austenite 36 (dark) form in alternate layers to make up the lacy-shaped constituent that surrounds the primary austenite dendrites. The nickel and molybdenum are in solid solution in the carbide and austenite constituents and increase hardenability.

Figure 3:
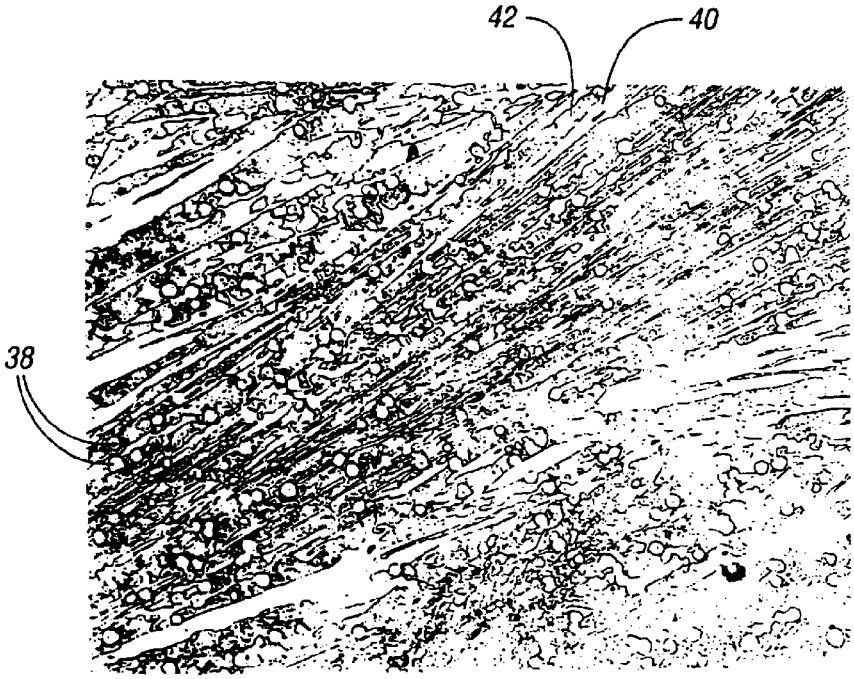
FIG. 3 shows a microstructure of another alloy according to the invention and made by the process of the invention.

FIG. 3 illustrates at 200 magnification another example of a microstructure of an alloy according to the present invention. This alloy by weight is composed of:

4.0% Carbon

15% Chromium 8.4% Vanadium 1.1% Nickel 0.6% Molybdenum

Balance Iron

This alloy includes primary MC vanadium carbides, eutectic $M_7C_3$ chromium carbides and eutectic austenite. The primary MC vanadium carbides 38 are the small compact particles dispersed throughout the alloy. The eutectic $M_7C_3$ chromium carbides 40 (white) and eutectic austenite 42 (gray) form in alternate layers as the two lamellar constituents that make up the balance of the microstructure. The nickel and molybdenum are in solid solution in the carbide and austenite constituents and increase hardenability.

Figure 4:
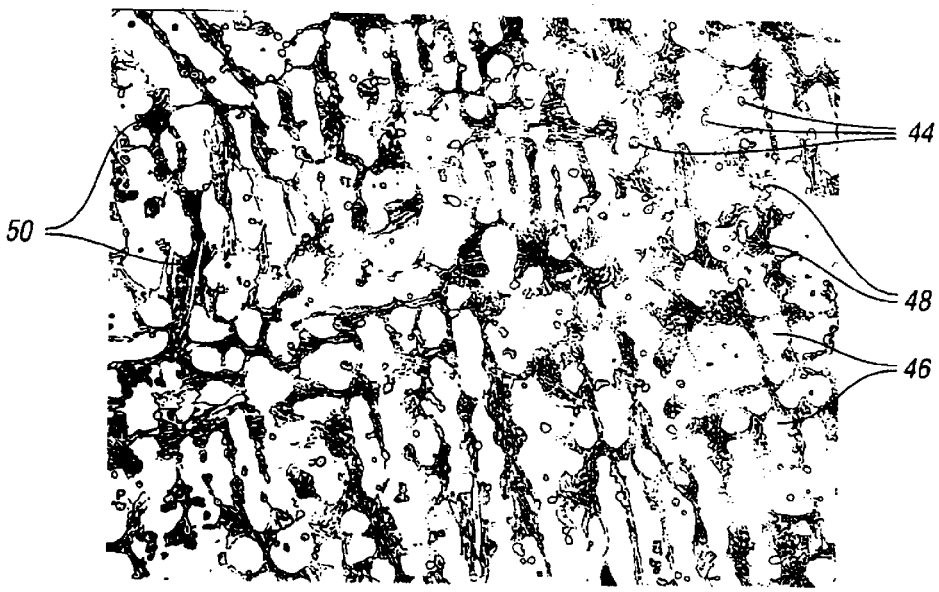
FIG. 4 shows a microstructure of a further alloy according to the invention and made by the process of the invention.

FIG. 4 illustrates at 200 magnification a further example of a microstructure of an alloy according to the present invention. This alloy is composed of:

2.8% Carbon

15% Chromium

3% Titanium 0.5% Molybdenum 0.6% Nickel

Balance Iron

This alloy includes primary MC titanium carbides, proeutectic austenite dendrites, eutectic $M_7C_3$ chromium carbides and eutectic austenite. The primary MC titanium carbides 44 are small compact particles dispersed in the proeutectic austenite dendrites 46. Eutectic $M_7C_3$ chromium carbides 48 (white) and eutectic austenite 50 (dark) form in alternate layers to make up the lacy-shaped constituent that surrounds the primary austenite dendrites. The nickel and molybdenum are in solid solution in the carbide and austenite constituents and increase hardenability.

Figure 5:
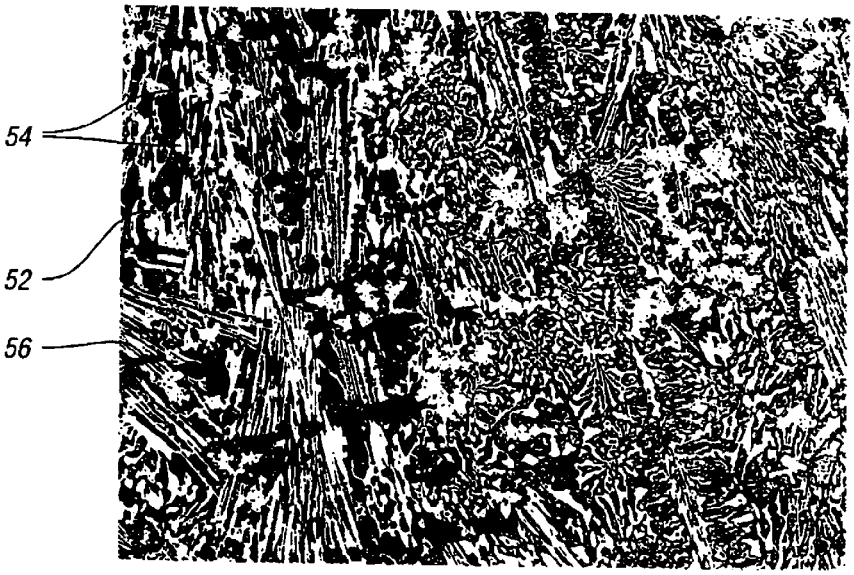
FIG. 5 shows a microstructure of a still further alloy according to the invention and made by the process of the invention.

FIG. 5 illustrates at 200 magnification a further example of a microstructure of an alloy according to the present invention. This alloy by weight is composed of:

3.8% Carbon

14% Chromium

6% Vanadium 4.2% Niobium 1.0% Nickel 0.5% Molybdenum

Balance Iron

This alloy includes primary MC niobium and vanadium carbides, proeutectic austenite dendrites that have been partially converted to martensite, eutectic $M_7C_3$ chromium carbides and eutectic austenite that has been partially converted to martensite. The primary MC niobium and vanadium carbides 52 are compact and clustered particles dispersed throughout the alloy. The eutectic $M_7C_3$ chromium carbides 54 (white) and eutectic austenite 56 (dark) form in alternate layers as the two lamellar constituents that make up the balance of the microstructure. The nickel and molybdenum are in solid solution in the carbide and austenite constituents and increase hardenability.

All of the examples of the alloy thus have a relatively high percentage of chromium, about 15% or more, as well as having an appropriate amount of carbon such that the eutectic 12 (FIG. 1) of the iron-carbon-M system is below the hypoeutectic austenite liquidus 16 of the iron-carbon-chromium system such that there is no formation of eutectic carbides of vanadium, niobium or titanium as previously mentioned.

While the best modes for practicing the invention have been described in detail, those familiar with the art to which this invention relates will recognize various alternative designs and embodiments for practicing the invention as defined by the following claims.

What is claimed is:

1. A process for making an iron-based casting alloy, comprising:

precipitating eutectic chromium carbides of a first alloy system and primary carbides of a second alloy system selected from the group consisting of vanadium carbides, niobium carbides, titanium carbides and combinations thereof; and the primary carbides being precipitated at a primary carbide liquidus of the second alloy system which has a eutectic that is maintained below an austenite liquidus of the first alloy system to prevent formation of eutectic carbides of the second alloy system.

2. A process for making an iron-based casting alloy as in claim 1 wherein the eutectic chromium carbides of the first alloy system are precipitated at a eutectic thereof without forming primary chromium carbides.

3. A process for making an iron-based casting alloy as in claim 1 wherein proeutectic austenite is precipitated at an austenite liquidus of the first alloy system prior to the precipitation of the eutectic chromium carbides.

4. A process for making an iron-based casting alloy, comprising:

precipitating eutectic chromium carbides of a first alloy system and primary carbides of a second alloy system selected from the group consisting of vanadium carbides, niobium carbides, titanium carbides and combinations thereof;

the primary carbides being precipitated at a primary carbide liquidus of the second alloy system which has a eutectic that is maintained below an austenite liquidus of the first alloy system to prevent formation of eutectic carbides of the second alloy system;

the eutectic chromium carbides of the first alloy system being precipitated at a eutectic thereof without forming primary chromium carbides; and proeutectic austenite being precipitated at an austenite liquidus of the first alloy system prior to the precipitation of the eutectic chromium carbides.

* * * * *